US005961192A

United States Patent [19]

Bernart et al.

[11] Patent Number: 5,961,192

[45] Date of Patent: Oct. 5, 1999

[54] MOBILE COMPUTER WORK STATION

[75] Inventors: R. Francis Bernart, North Canton; Michael S. Jaeb, Hiram; Aaron D. Shaffer, Akron, all of Ohio

[73] Assignee: The Little Tikes Company, Hudson, Ohio

[21] Appl. No.: 09/020,304

[22] Filed: Feb. 6, 1998

[51] Int. Cl.[6] ..... A47B 81/00

[52] U.S. Cl. ..... 312/223.3; 108/60; 312/196; 312/257.1; 312/265.5

[58] Field of Search ..... 312/257.1, 258, 312/262, 265.5, 237, 195, 196, 223.6, 223.3, 5, 6, 7.2; 248/917, 918; 160/351, 352; 108/60

[56] References Cited

U.S. PATENT DOCUMENTS

| | | | |
|---|---|---|---|
| D. 242,317 | 11/1976 | Hofmann | D6/162 |
| D. 250,336 | 11/1978 | Esslinger et al. | D14/44 |
| D. 269,196 | 5/1983 | Appel et al. | D21/121 |
| D. 289,114 | 4/1987 | Dickson | D6/421 |
| D. 358,434 | 5/1995 | Brown et al. | D21/121 |
| D. 367,568 | 3/1996 | Strayer | D6/422 |
| D. 381,836 | 8/1997 | Martin | D6/428 |
| 3,541,256 | 11/1970 | Anders | 178/7.9 |
| 4,345,803 | 8/1982 | Heck | 312/194 |
| 4,712,842 | 12/1987 | Price et al. | 312/196 |
| 4,861,121 | 8/1989 | Gotz | 312/208 |
| 5,242,217 | 9/1993 | Gonnet | 312/194 X |
| 5,322,025 | 6/1994 | Sherman et al. | 108/147 |
| 5,416,666 | 5/1995 | Maguire, Jr. | 361/681 X |

(List continued on next page.)

OTHER PUBLICATIONS

Pp. 84 and 88, Computer desks; Dealers Office Equipment Inc., 19300 Janacek Court, Waukesha, Wisconsin 53186. Publication date Apr., 1992.

Catalog page, Computer desks; Dealers Office Equipment Inc., 19300 Janacek Court, Waukesha, Wisconsin 53186. Publication date Apr., 1992.

P. 70, Computer desks; Global Computer Supplies, 9139 Hemlock Drive, Hempstead, New York 11550. Publication date Jul. 13, 1984.

Pp. 142, 158, 159, 162 and 163, Computer desks; Global Computer Supplies, 2318 East Del Amo Blvd., Dept. 31, Compton, California 90220. Publication date Jan., 1992.

Pp. 110, 111, 116, 117 and 119, Computer desks; Visible, A Subsidiary of Wallace Computer Services, Inc., 1750 Wallace Avenue, St. Charles, Illinois 60174. Publication date Fall/Winter 1992.

P. 211, Computer desk; Inmac, 2465 Augustine Drive, P. O. Box 58031, Santa Clara, California 95052–8031. Publication date Nov., 1987.

(List continued on next page.)

*Primary Examiner*—Lynne Reichard
*Assistant Examiner*—Brian H. Buck
*Attorney, Agent, or Firm*—Richard B. O'Planick

[57] ABSTRACT

A mobile computer work station for a personal computer is disclosed comprising a wheel mounted cabinet (12) for enclosing the computer CPU therein and supporting a computer monitor thereon. A concave vertical partition (18) mounts to a forward side of the cabinet (12) and defines a three sided user station providing improved acoustic and visual isolation to the user. A window (120) extends through the partition (18) and receives the screen of the computer monitor therein. A bezel plate (26) affixes to a forward side of the partition (18) and surrounds the window (120). A lower portion (122) of the plate (26) protects the controls to the monitor there behind from unauthorized tampering. A speaker cavity is defined behind the lower plate portion (122) likewise isolated thereby from unauthorized contact. S-shaped support bars (14, 16) structurally connect cabinet (12) and partition (18) and support a keyboard support plate (20) upon bar segments (98) within the concave partition (18). A second bezel plate (24) attaches to a top surface of plate (20) to retain a touch sensitive keyboard component thereon.

25 Claims, 9 Drawing Sheets

U.S. PATENT DOCUMENTS

| | | | |
|---|---|---|---|
| 5,474,373 | 12/1995 | Forester | 312/196 |
| 5,558,418 | 9/1996 | Lambright et al. | 312/321.5 X |
| 5,746,489 | 5/1998 | Moon | 312/223.3 |
| 5,758,935 | 6/1998 | Coonan | 312/223.3 |
| 5,803,562 | 9/1998 | Jacobs et al. | 312/283 X |
| 5,865,125 | 2/1999 | Alexander et al. | 108/50.011 X |
| 5,904,410 | 5/1999 | Davies | 312/259 X |

OTHER PUBLICATIONS

P. 85, Computer desks; Misco, One Misco Plaza, Holmdel, New Jersey 07733. Publication date Apr., 1992.

Pp. 60, 61 and 78, Computer desks; United Stationers Supply Company, 2200 East Golf Road, Des Plaines, Illinois 60016. Publication date 1988.

P. 81, Computer desks; United Stationers Supply Company, 2200 East Golf Road, Des Plaines, Illinois 60016. Published at least as early as Feb., 1994.

Pp. 75, 81 and 83, Computer desks; Uarco Business Products, UARCO Incorporated, 121 North 9th Street, DeKalb, Illinois 60115. Publication date Spring 1992.

Pp. 29 and 36, Computer desks; Sauder Woodworking Co., 502 Middle Street, Archbold, Ohio 43502. Publication date Dec., 1995.

P. 163, Computer desks; Global Computer Supplies, 2318 East Del Amo Boulevard, Dept. 31, Compton, California 90220. Publication date Jan., 1992.

P. 116, Desk; The Little Tikes Company, 2180 Barlow Road, Hudson, Ohio 44236. Publication date 1992.

Brochure page, Kiosk; The Little Tikes Company, 2180 Barlow Road, Hudson, Ohio 44236. Publication date 1995.

MOBILE COMPUTER WORK STATION

BACKGROUND OF THE INVENTION

1. Field of the Invention

The subject invention relates generally to computer work stations and, in particular, to mobile computer work stations suitable for integral use with a personal computer.

2. The Prior Art

The personal computer has found widespread application in the work place, homes and, increasingly, schools. It has become common in elementary and preschool classrooms to provide teachers with access to a personal computer for instructional purposes. In some schools one or more computers are dedicated to a classroom. In others, a computer is shared by more than one classroom and must be moved from one room to another. Mobility, therefore, is required.

In the classroom, students often share a computer on a rotational basis and use of the computer by students is often unsupervised. Security of the computer controls from tampering by students is often a problem for the teacher, particularly with younger students. Resetting altered computer controls is distracting to the teacher and interrupts other productive instruction.

An ancillary problem to sharing personal computers in a crowded classroom is that the noise from their use can be distracting to the other students. Physical isolation of the computer from the surrounding class is often not practical due to the crowded conditions in many schools.

Conventional desks sold for use with personal computers provide adequate surfaces for supporting the monitor, keyboard, and CPU housing of a personal computer but fail generally in meeting the needs of the market described above. Available work stations generally provide a work surface, a stand or shell to the rear of the work surface for supporting a video monitor, and a drawer for the keyboard at a forward of the work surface. A computer CPU housing is either stationed upon the work surface or is located on end on the floor beside the work station.

While functional, the available computer work stations do not prove the mobility required in many school applications. Nor do they provide security from unauthorized student manipulation of the controls of the computer CPU, monitor, speakers, or keyboard. Finally, conventional work stations are not acoustically isolated and the sound emanating therefrom can distract surrounding students.

SUMMARY OF THE INVENTION

The subject invention overcomes the aforementioned shortcomings in conventional computer work station. A wheel mounted cabinet is provided to enclose a computer central processing unit housing and render the work station mobile and the computer central processor unit safe from unauthorized access. The wheels of the cabinet allow its ready transportation to different locations. The top surface of the cabinet is dimensioned and shaped to support a computer video monitor. Mounted to a forward side of the cabinet is a vertical partition having a concave shape and defining a user station. A window is dimensioned and shaped to align with the screen of the video monitor. A first bezel plate surrounds the screen and affixes to the vertical partition. A lower portion of the first bezel plate is located so as to obscure the lower controls of the monitor and render them inaccessible absent removal of the bezel plate and covers a speaker cavity so that the controls of the speakers are likewise inaccessible.

S-shaped support bars are anchored at one end to the bottom of the CPU cabinet and project upward and forward therefrom through the vertical partition. Second end segments of the support bars support a keyboard platform. A central depression within the keyboard platform receives a keyboard support pad and a touch-sensitive keyboard. A second bezel plate is further provided that attaches to the keyboard platform to secure the keyboard to the keyboard platform.

A computer speaker cavity is defined behind the lower portion of the first bezel plate dimensioned to house and physically isolate one or more computer speakers. Slots through the first bezel plate lower portion direct the sound from the speakers into the concave user station. The shape of the partition and the orientation of the speakers relative thereto minimize the noise disturbance to surrounding areas. Moreover, the lower portion of the first bezel plate renders the speakers inaccessible to the computer user absent removal of the plate.

Accordingly, it is an objective of the present invention to provide a computer work station that is mobile and readily relocatable.

A further objective is to provide a computer work station providing enhanced acoustic isolation.

Still another objective is to provide a computer work station for a personal computer system having improved means for securing and rendering inaccessible to unauthorized parties the controls to the central processing unit, the computer monitor, the keyboard, and the speakers of the computer system.

Yet another objective is to provide a computer work station capable of accommodating standard dimensioned video monitors, keyboards, and central processing housings.

A further objective is to provide a computer work station having a user station visually and acoustically isolated from the surrounding environ.

Another objective is to provide a computer work station comprised of a minimal number of inexpensively produced components rendering the station cost effective and readily assembled.

These and other objectives, which will be apparent to one skilled in the art, are achieved by a preferred embodiment which is described in detail below and which is illustrated by the accompanying drawings.

DESCRIPTION OF THE PREFERRED EMBODIMENT

Figure 1:
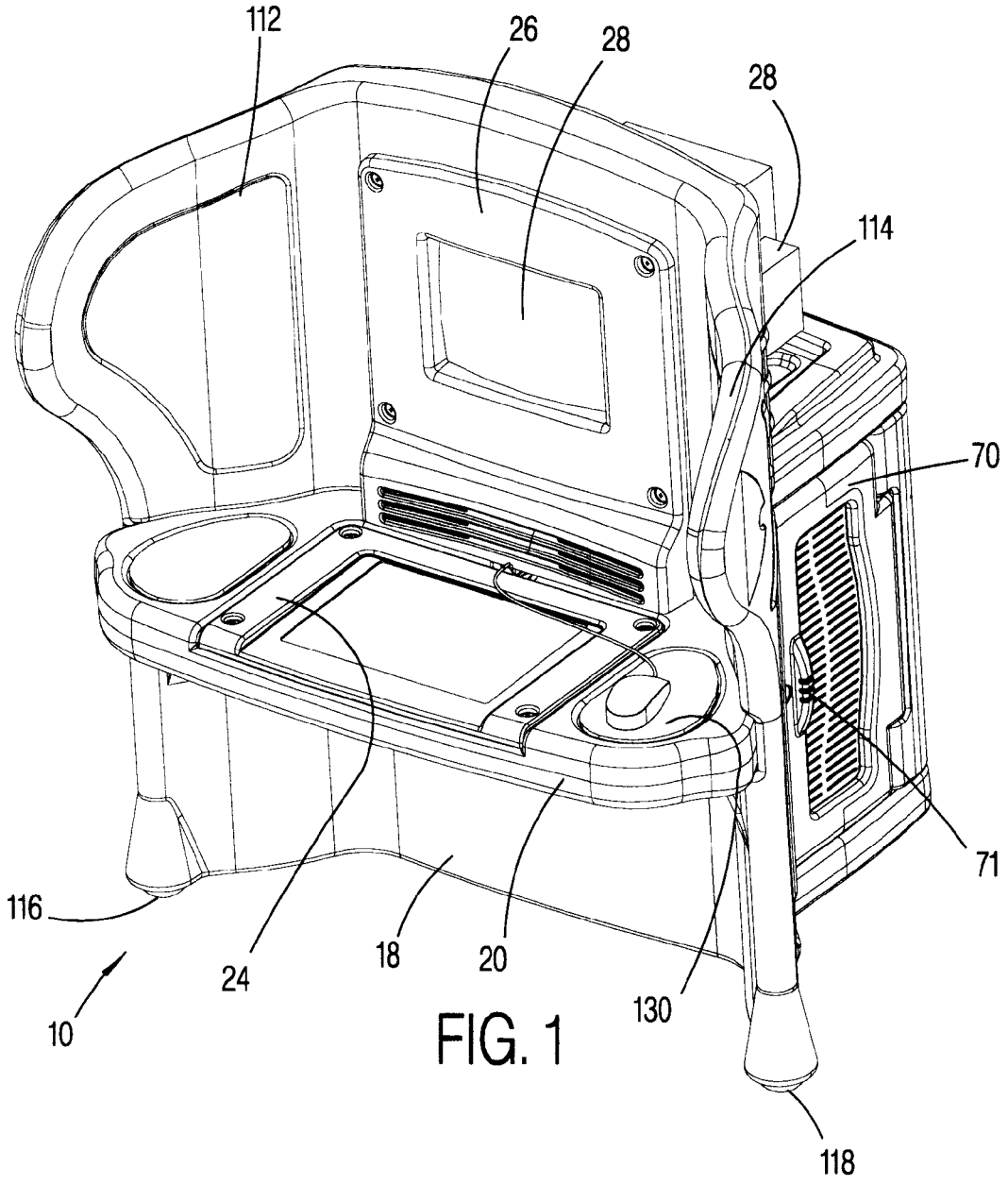
FIG. 1 is an assembled front perspective view of the subject computer work station.
Figure 2:
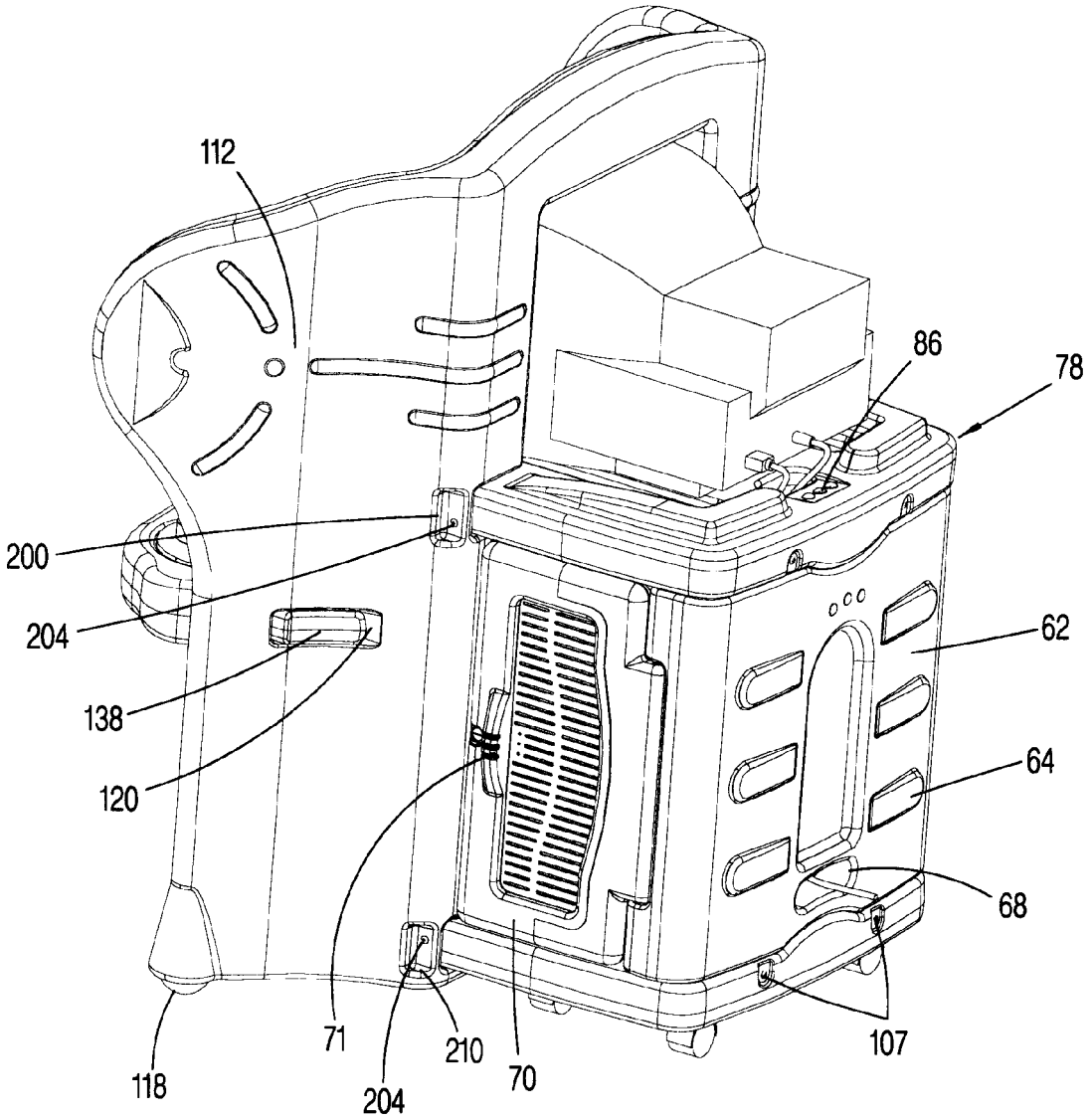
FIG. 2 is an assembled left rear perspective view thereof.
Figure 4:
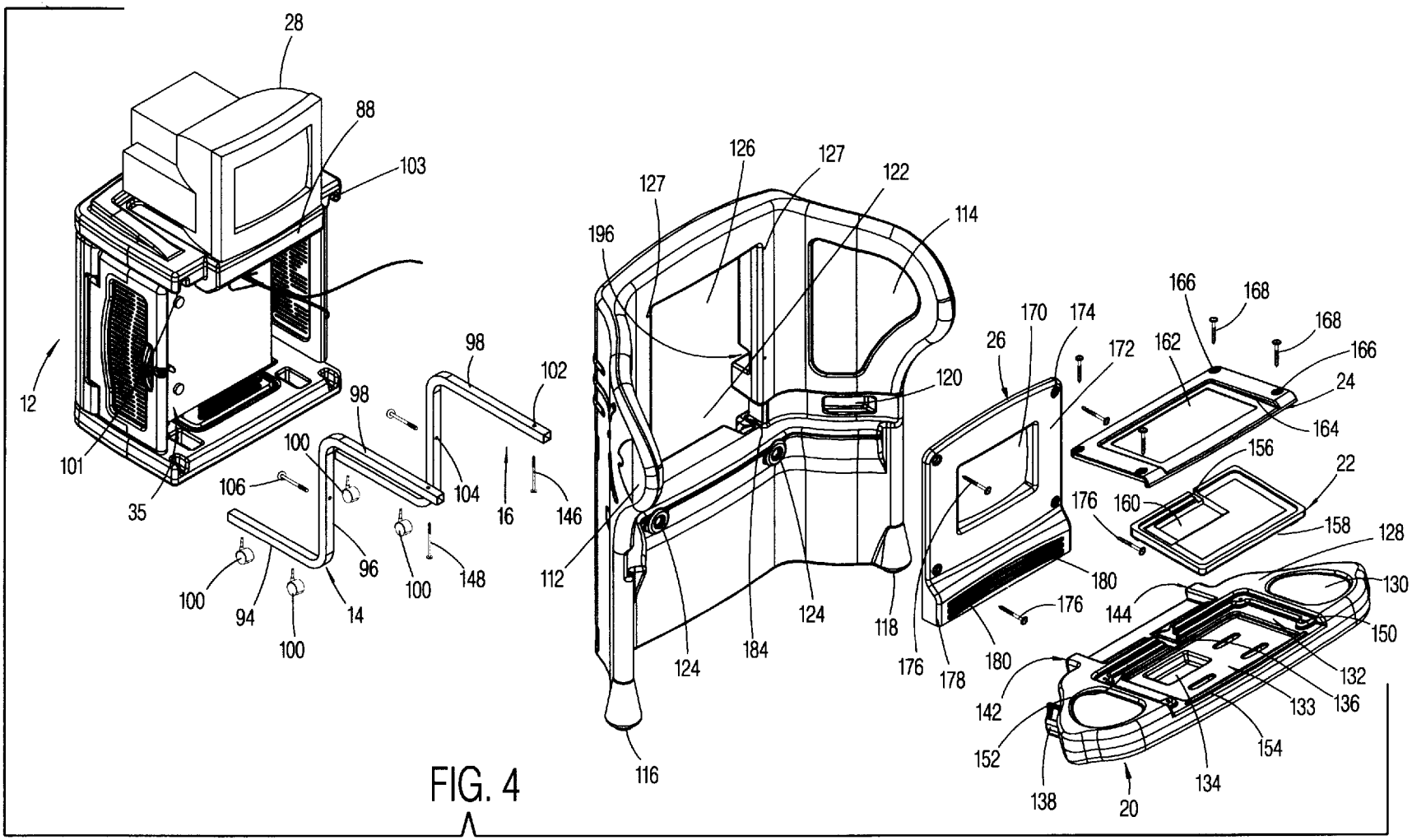
FIG. 4 a partially exploded perspective view thereof.
Figure 5:
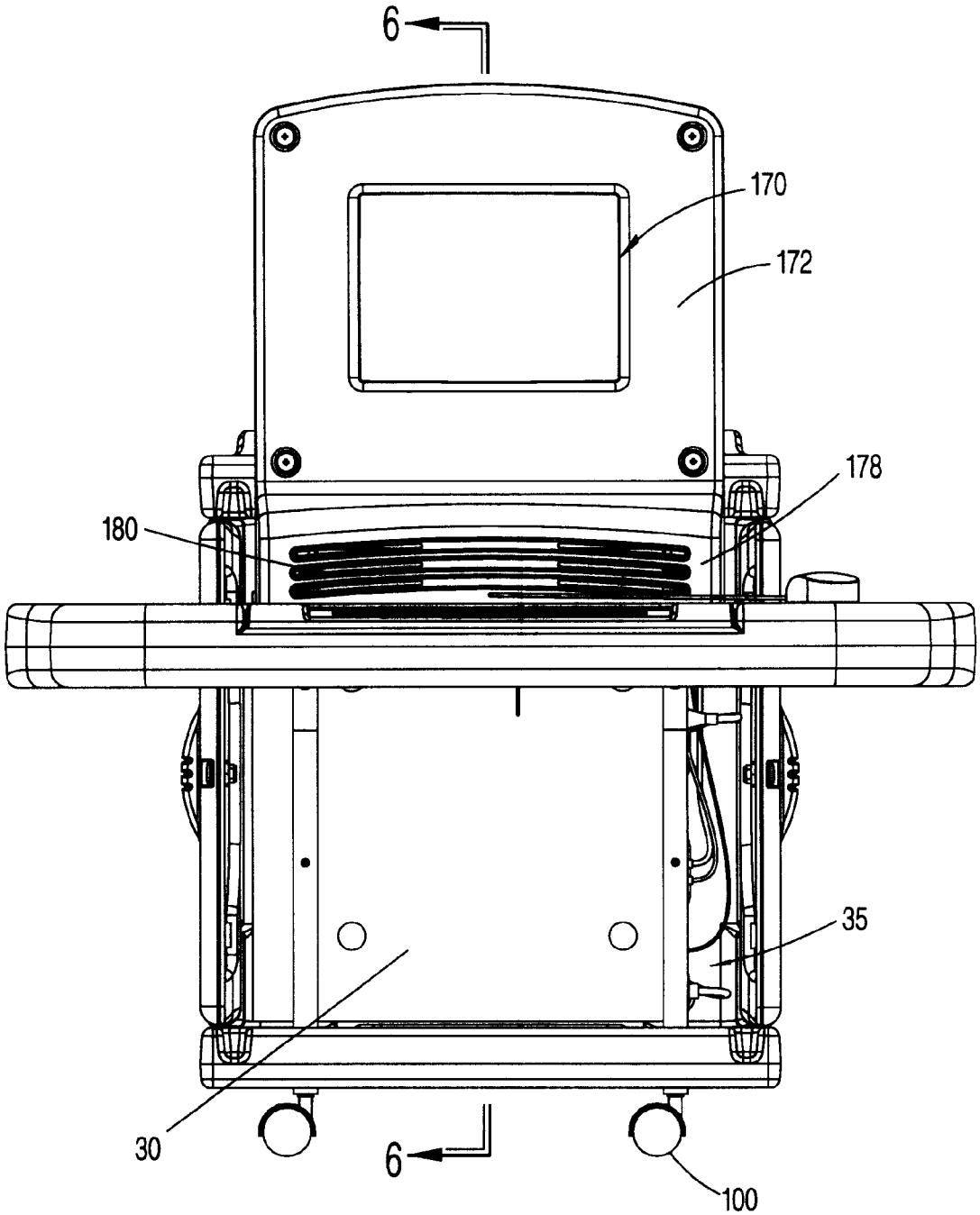
FIG. 5 is a front plan view of the partially assembled computer work station, shown without the vertical partition.
Figure 6:
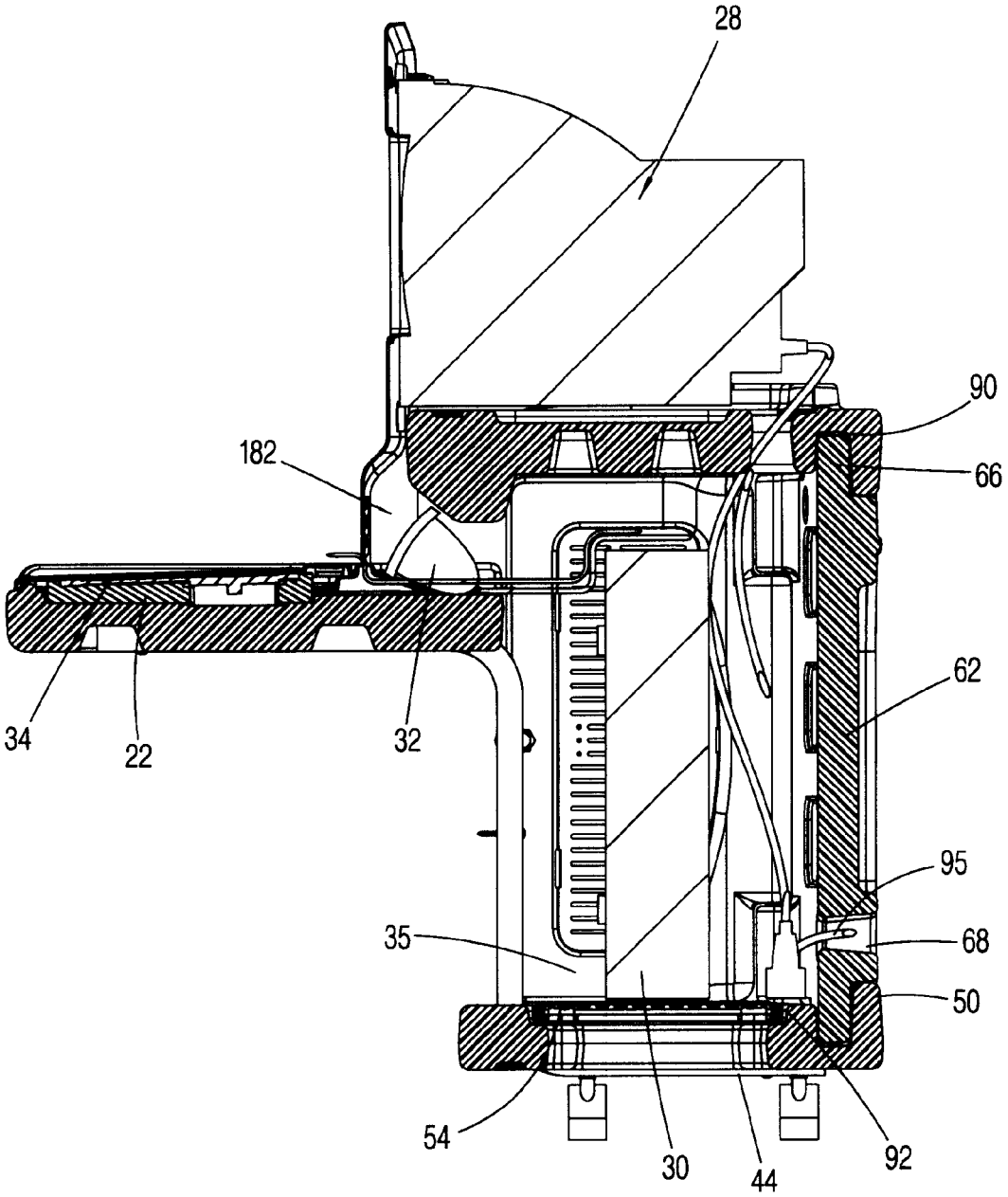
FIG. 6 is a transverse section view through the partially assembled computer work station of FIG. 5, taken along the line 6—6.

Referring initially to FIGS. 1, 4 and 6, the subject computer work station 10 is shown to generally comprise a central processor unit (hereinafter "CPU") cabinet 12; a pair of S-shaped support bars or tubes 14, 16; a vertical partition 18; a keyboard support platform 20; a keyboard support insert 22; a keyboard bezel plate 24; and a monitor bezel plate 26. The work station 10 is intended to be used in conjunction with a personal computer system, generally comprising a video monitor 28, a rectangular, four sided CPU housing 30, a pair of speakers 32; a touch sensitive keyboard 34; and a mouse control (not shown).

Figure 8:
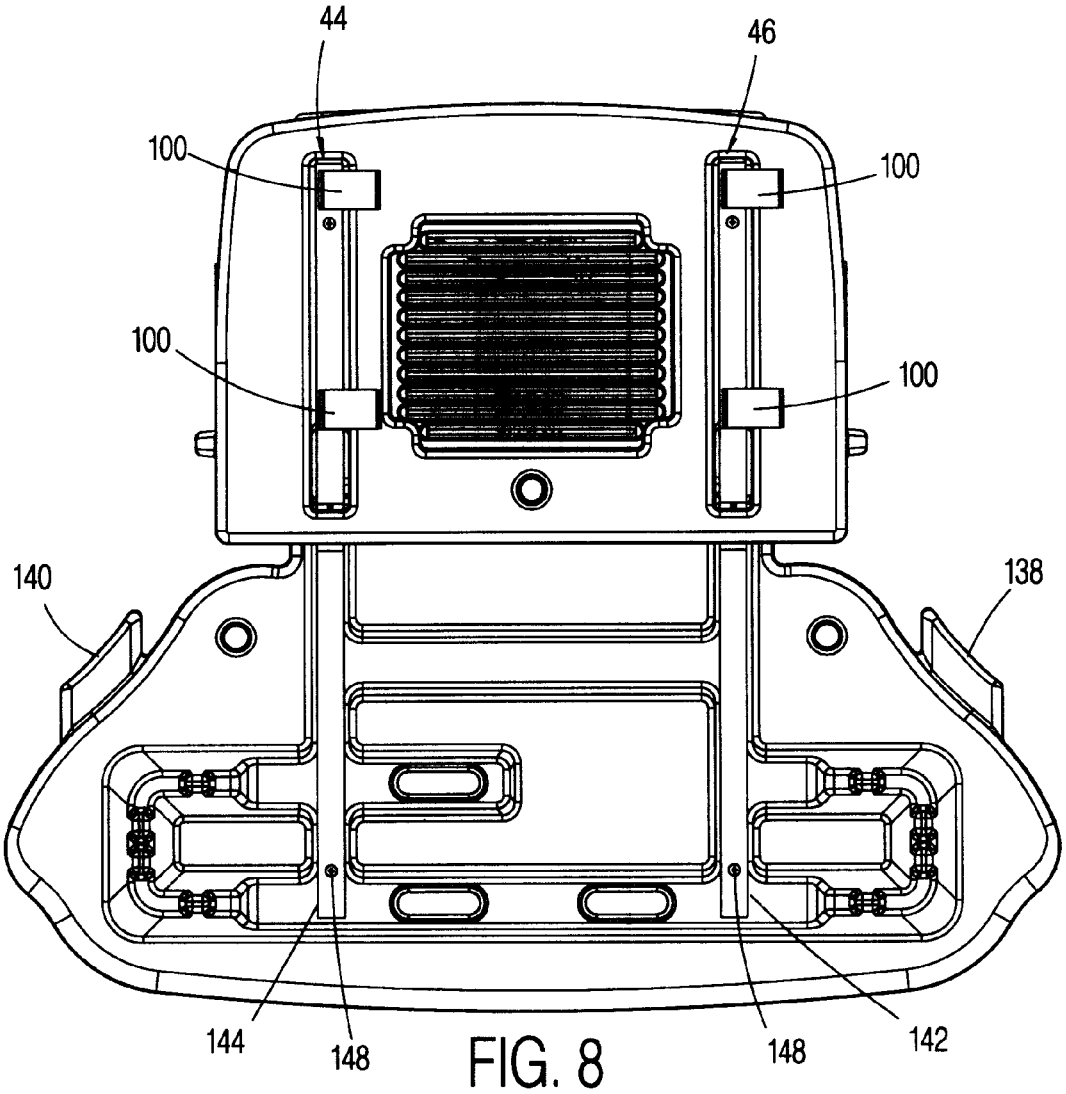
FIG. 8 is a bottom plan view of the assembled computer work station.
Figure 9:
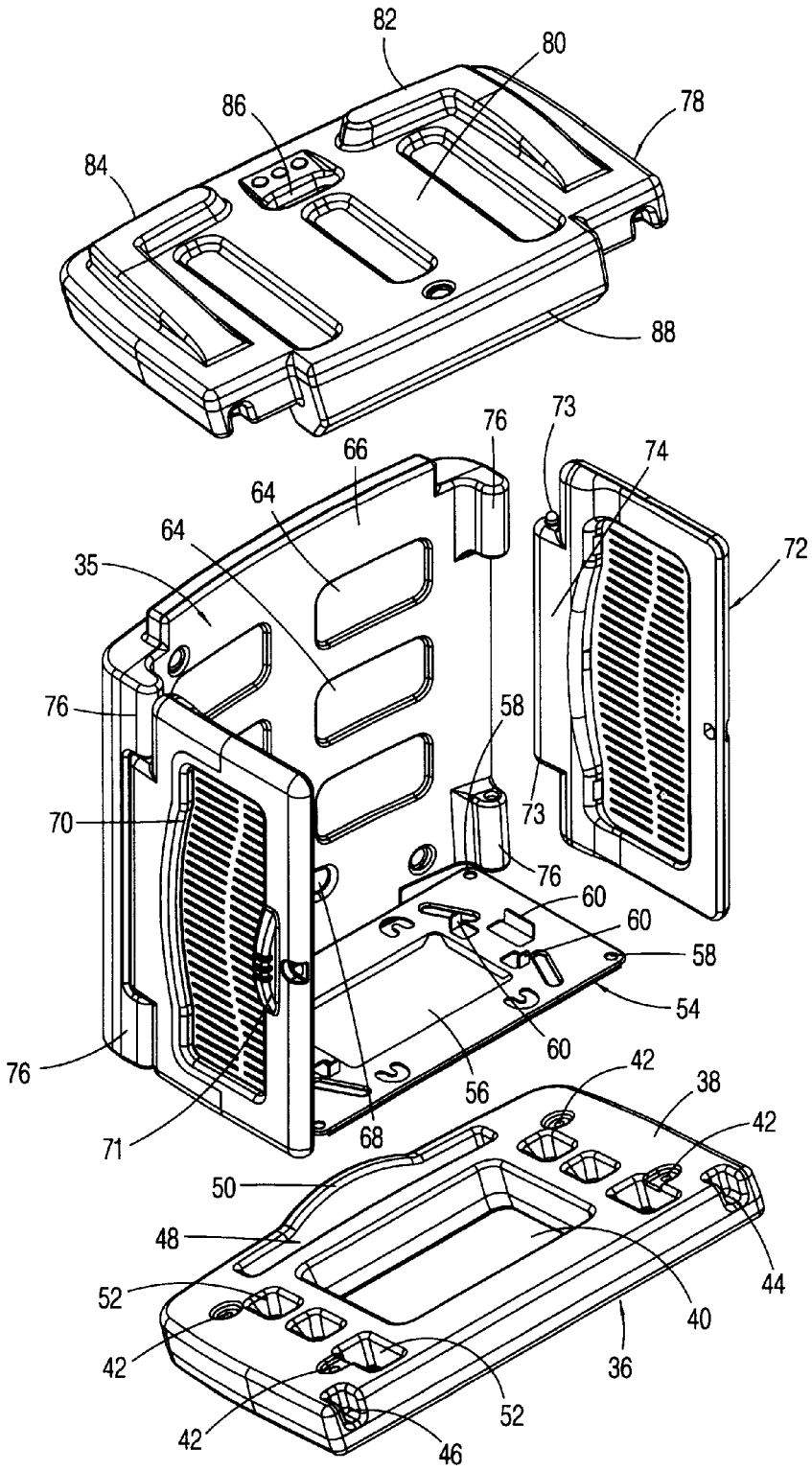
FIG. 9 is an exploded perspective view of the cpu cabinet.

FIGS. 6, 8 and 9 illustrate the CPU cabinet 12 of the subject work station intended to house and isolate from unauthorized access, the CPU of the computer system within an internal compartment 35. Cabinet 12 comprises a generally flat and rectangularly shaped lower panel 36 having a planar top surface 38. A rectangular central opening 40 extends through panel 36 and four, counter sunk screw bores 42 are provided extending into surface 38 at the corners of the opening 40.

A pair of spaced apart and parallel channels 44, 46 extend along an underside of the panel 36 as best seen if FIG. 8. Extending within the top surface 38 proximate a rearward edge is an elongate assembly channel 48 and an upwardly projecting flange 50. Multiple recessed pockets 52 are formed within the top surface 38 as a result of the preferred rotational molding manufacturing method of forming the panel from plastics material. Preferably the panel 36 is formed by the rotational molding manufacturing process out of commonly available plastic resin such as polyethylene.

A rectangular vibration dampening plate 54 formed of stamped metal is provided having a rectangular shaped through opening 56 and four assembly apertures 58 at the corners. Five upwardly extending brackets 60 are stamped during the fabrication of plate 54, and are located at the corners of the opening 56. The brackets, as will be further explained later, are spaced apart to accept a CPU housing therebetween and act as a locator to position the CPU.

A rear panel 62 is likewise provided as part of the CPU cabinet 12, manufactured of common plastic material such as polyethylene, preferably by a rotational molding process. The panel 62 has an array of rectangular recesses 64 extending therein. An edge flange 66 extends upward from an upper edge and a cable aperture 68 extends through a bottom portion of the panel. Upper and lower end portions 76 of the panel 62 are radiused inward and have hinge sockets (not shown) formed therein for a purpose explained below.

The side panels 70 and 72 comprise plastic molded doors, formed preferably by a blow molding process of polyethylene resin. A pivotal latch mechanism 71 of a type common in the industry is affixed to each door 70, 72 and latches to an edge of the panels 70, 72 surrounding the door openings in conventional manner. The doors 70, 72 are on opposite sides of the cabinet 12 and serve to provide access into compartment 35. The doors 70, 72 each have a hinge edge flange 74 along a side opposite the latch mechanism 71 which is received between portions 76 of the rear panel 62. The edge 74 is formed to provide upward and downward pivot pin segments 73 which are snapped into respective sockets in portions 76 and reside therein to pivotally connect each door 70, 72 to a respective side of the rear panel 62.

The top panel 78 component of the cabinet 12 is likewise manufactured preferably of polyethylene in a rotational molding process. The panel 78 has a planar top surface 80 of rectangular shape. A pair of L-shaped centering flanges 82, 84 project upward at respective rearward corners of panel 78 and center a video monitor upon surface 80. A cable aperture 86 proximate a rearward edge of the panel 78 extends downward from surface 80 through the panel 78, and an elongate shoulder 88 extends along from the forward edge of the panel 78. As best seen from FIG. 6, an elongate channel 90 is formed within the underside of panel 78 and extends generally along the rearward panel edge.

A power strip conventional in the computer industry is provided as part of the cabinet assembly, and is positioned upon the vibration dampening plate 54.

First and second S-shaped steel bars 14, 16, as best seen in FIGS. 4 and 6, are formed having a generally square cross section. The bars 14, 16 include a first elongate end segment 94, an upwardly projecting elongate mid-segment 96, and an elongate second end segment 98. Four casters 100 mount to undersides of bar first segments 94 in conventionally fashion. Two pairs of grommets 102 extend into end segments 98 and an aperture 104 extends into and through the mid-segment 96 of each bar. Appropriate hardware screws 106 and 108 are provided to project through apertures 104, 102, respectively.

Assembly of the cabinet proceeds as follows with reference to FIGS. 4, 6 and 9. The lower panel underside channels 46 receive the lower first segments 94 of the bars 14, 16 therein and casters 100 assemble to the underside of segments 94. The vibration dampening plate 54 sits on rubber bushings (not shown) and the bushings are mounted to surface 38 of the panel 36 and opening 56 of the plate 54 aligned with the opening 40 of panel 36. Appropriate screws (not shown) attach through apertures 58 of plate 54 and 42 of the panel 36 to fix plate 54 in place. A power strip is sized to position along a rearward length of the plate 54.

A lower edge of rearward panel 62 is received within the channel 48 of lower panel 36 and screws 107 (FIG. 3) are provided to secure the parts together. The doors 70, 72 are pivotally mounted between portions 76 of the rearward panel 62 as described previously. The top panel 78 mounts over the upper edge of the rearward panel 62 as flange 66 is received into channel 90. Screws 105 (FIG. 3) are provided to secure the parts together. The mid-segments 96 of the bars 14, 16 extend upward at the forward side of the cabinet 12 between forward ends of the lower and upper panels 36, 78 as will best be appreciated from FIG. 4. The forward edges of doors 70, 72 are recessed inward from the forward ends 101, 103 of the upper panels 36, 78 so as to allow a space to interfit with the vertical partition as described below.

It will also be noted from FIG. 4 that the computer monitor 28 is positioned upon the upper surface of the top panel 78 and extends forward upon the forward edge shoulder 88. As such, the monitor overhangs the cabinet 12. The computer CPU is housed within compartment 35, accessed through either door 70 or door 72. The CPU is vertically oriented to rest upon the vibration dampening plate 54 and is centered and registered by brackets 60. The openings 40, 56 in the panel 36 and plate 54 overlap to provide adequate ventilation into compartment 35. The apertures 64 in rearward panel 62 further aid in the ventilation of compartment 35.

Cable and power cord from the monitor are routed down through aperture 86 and into compartment 35 for connection to the CPU and the power strip 92 as appropriate. The power strip 95 cable emerges through panel aperture 68 of rearward panel 62 and can be plugged into an external outlet.

Figure 7:
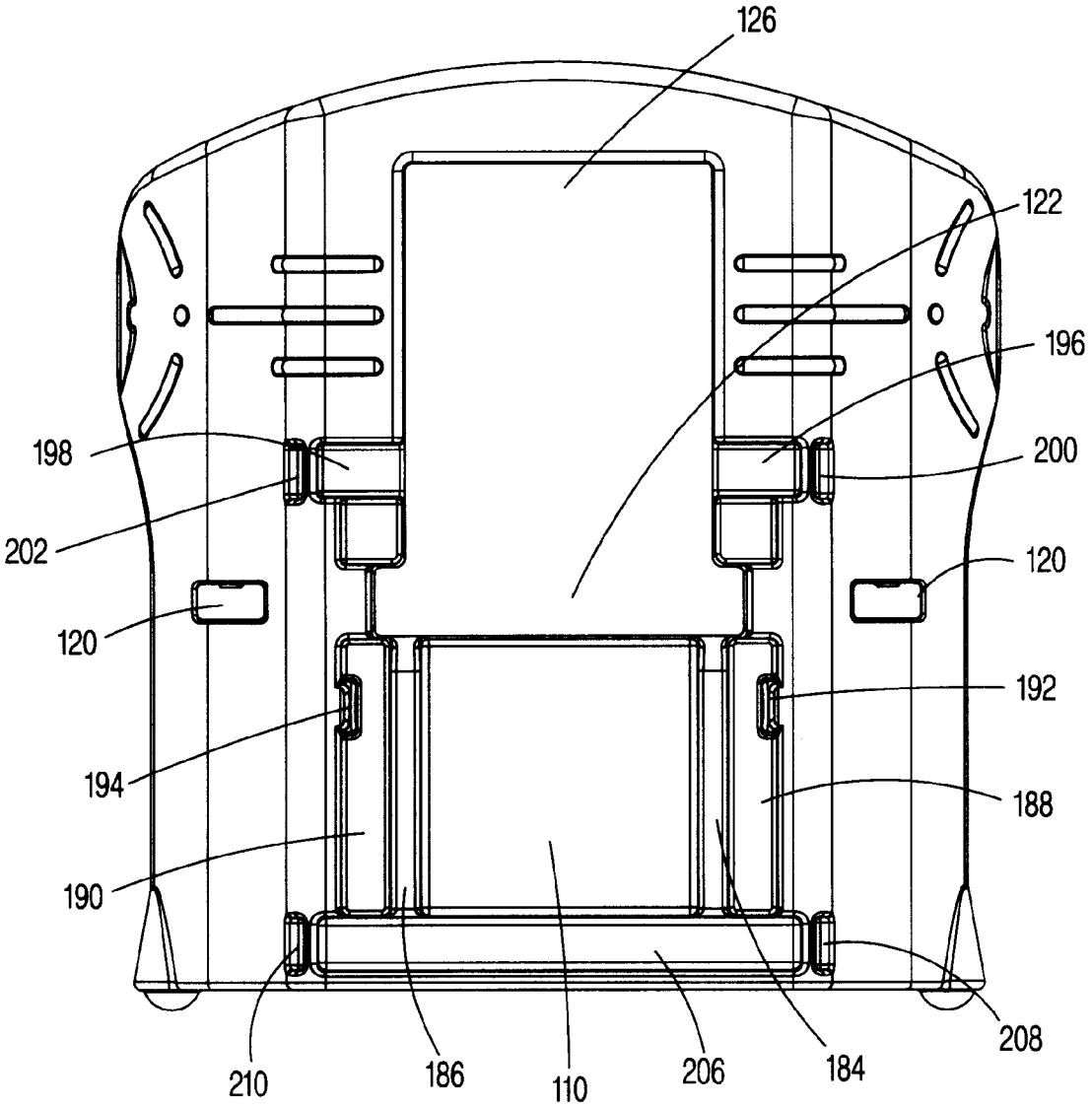
FIG. 7 is a rear plan view of the vertical partition.

With reference to FIGS. 1, 4 and 7, the vertical partition 18 has a central planar portion 110 and first and second wing portions 112, 114 that flare outwardly from portion 110. The partition 18 is preferably formed as the panels previously described; that is, by a rotational molding process from plastic material such as polyethylene. The partition is supported by spaced apart feet 116, 118. Each wing has a rectangular slot 120 extending therethrough positioned substantially mid-way up the vertical dimension. Portals 124 are disposed in the panel as a consequence of the plastic rotational molding operation.

A rectangular window 126 is centered and extends through the partition portion 110. The window is sized and of a vertical height to admit the forward face of computer monitor 28 therein from a rearward direction and includes a lower window portion 122. From the rearward view of FIG. 7 it will be seen that the central panel portion 110 has a pair of vertical, spaced apart bar-receiving channels 184, 186. Two molded posts 188, 190 extend adjacent the channels 184, 186 respectively, and proximate the top of each post 188, 190 a molded in latch detent 192, 194, respectively, is provided.

Panel portions at opposite sides of the window 126 proximate a lower end include rectangular socket cavities 196, 198. Adjacent each cavity are detents 200, 202. Screws 204 are provided to attach the partition to the cabinet assembly as explained below. Along a lower edge of the partition and extending therein is a lower channel 206. Adjacent ends of the lower channel are detents 208, 210.

Figure 3:
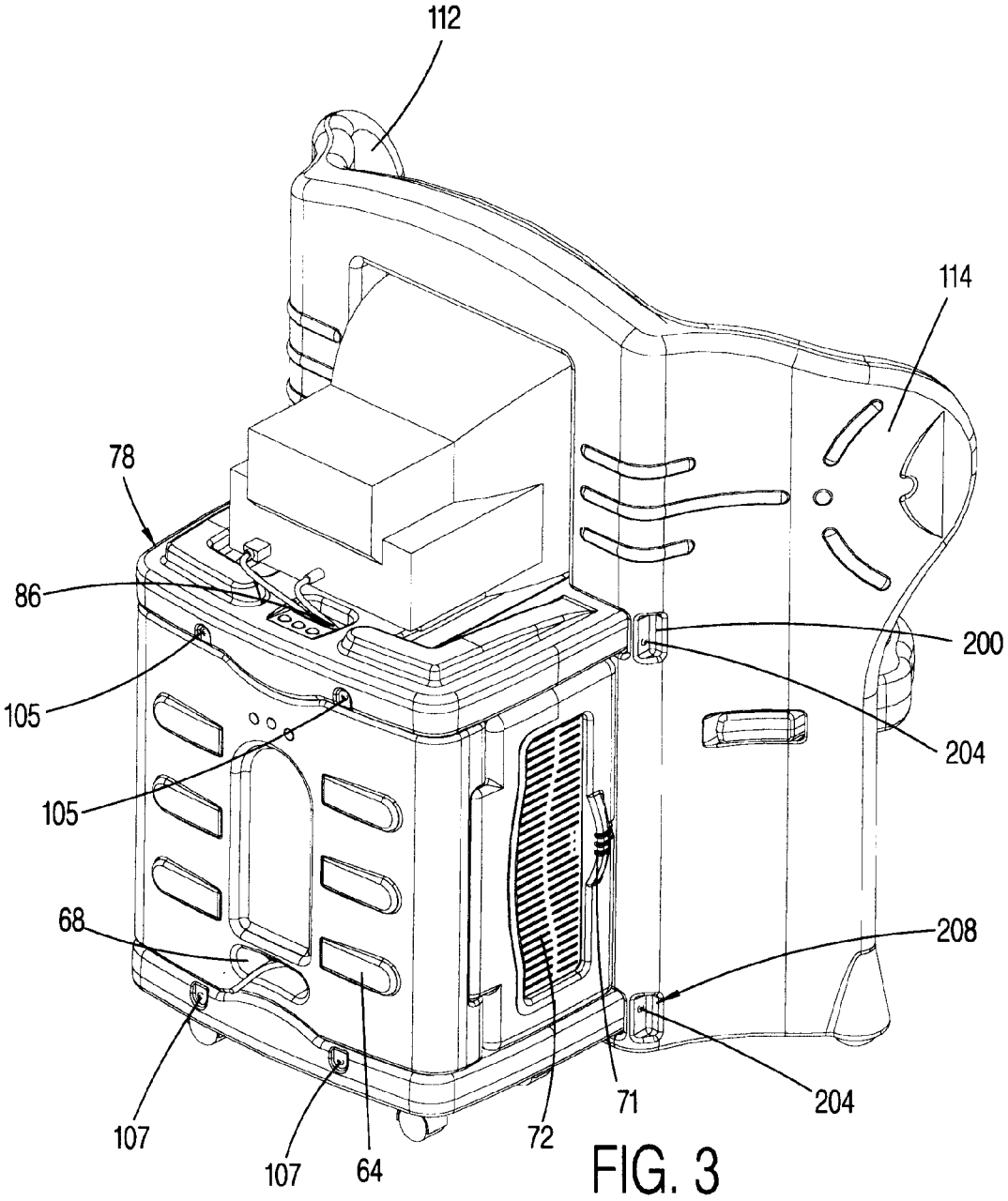
FIG. 3 is an assembled right rear perspective view thereof.

Assembly of the partition 18 to the cabinet assembly will be understood from FIGS. 3, 4 and 7. It will be appreciated that the forward segments 98 of the bars 14, 16 are inserted through the lower window portion 122 to a forward side of the partition 18, and mid-segments 96 of the bars enter into the channels 184, 186. As the cabinet 12 moves against the rearward side of the partition, the forward ends 101, 103 of the cabinet upper panel 78 enter into sockets 196, 198. The forward edge of the lower panel 36 enters into lower channel 206 of the partition. Thereafter, screws 204 are inserted into upper and lower detents 200, 202 and into the upper and lower panels 36, 78, to secure the panels to the partition. In the assembled condition, the lower portion of the partition encloses the cabinet compartment 35. The latch detents 192, 194 in the partition are situated adjacent the latch 71 of the side panel doors 70, 72. The latches 71 of each door engage in conventional manner into the detents 192, 194 of the partition to secure each door in the closed position.

It will further be noted that the flared wing portions 112, 114 form with central partition portion 110 a concave shape and define a user station that is substantially enclosed on three sides. Upon insertion of the bars 14, 16 through slot 122, the partition is assembled to the forward face of the cabinet 12 and encloses the forward side of the compartment 35.

With continued reference to FIGS. 4, 6, and 8, the keyboard support platform 20 is shown having an irregular elongate shape. The platform 20 is formed of plastic material by conventional means in the preferred embodiment. A planar top surface 128 is provided into which dual mouse pad receptacles 130 arc formed. The receptacles 130 are disposed toward respective ends of platform 20 adjacent a central, stepped keyboard receiving rectangular recess 132 having a lower central recess portion 133 therein. A rectangular through channel 134 is positioned at an upper corner of recess 132 and a cable channel 136 extends from the recess 132 toward a rearward side of the platform 20.

A pair of registration flange projections 138, 140 project outward and rearward from platform 20, located and dimensioned to enter into detent apertures 120 in the partition. First and second parallel channels 142, 144 are formed in the underside of the platform 20, dimensioned to closely receive the end segments 98 of the support bars 14, 16. Screws 146, 148 project upward through bar segments 98 and into the platform 20 to securely affix the platform to ends of bars 14, 16.

Extending downward into the platform at each corner of the recess 132 are sockets 150. Registration ribs 152, 154 extend along opposite longitudinal sides of the recess 132. The keyboard insert pad 22 is dimensioned to be closely received into the bottom of recess lower portion 133. Pad 22 is composed of soft plastic such as neoprene material and serves as a support base for the computer keyboard. The pad 22 has a through aperture 160 adjacent one corner that aligns with the opening 134 of the keyboard platform 20. A cable slot 156 extends through an edge flange 158 surrounding the pad 22 and aligns with the cable slot 136 of the platform 20. The edge flange 158 overlaps the registration ribs 152, 154 of the platform 20 to center the pad 22 on keyboard platform 20. The touch sensitive keyboard (not shown) of the computer system resides within the recess 132 upon the pad 22.

A rectangular keyboard bezel plate 24 is configured having a rectangular central opening 162 and narrow edge segments 164 define opening 162. Plate 24 is dimensioned to fit over the keyboard platform 20 and edge segments 164 overlap edges of the computer keyboard. Assembly apertures 166 are located at the corners of plate 24 and align with screw sockets 150 of the keyboard platform 20. Screws 178 attach through co-aligned apertures 166 and sockets 150 to affix the platform 20 and bezel plate 24 together and hold the keyboard in place upon the insert pad 22.

The video monitor bezel plate 26 is shown to comprise a central rectangular opening 170 defined by edge portions 172. Four screw apertures 174 extend through the plate 26 spaced to align with the apertures 127 proximate the partition window 126. Screws 176 extend through co-aligned apertures 174, 127 to detachably secure the plate 26 to the forward face of the partition 18.

The bezel plate 26 further includes a lower portion 178 that extends downward to the upper surface of the keyboard platform 20. The lower portion 178 has a series of through slots 180 therethrough. As best seen in FIG. 6, the lower portion 178 defines with the upper surface 128 of the keyboard platform a speaker cavity 182. With the speakers 32 of the computer system within the cavity 182, they are inaccessible from a forward side of the partition absent removal of the bezel plate 26.

The completely assembled computer work station is illustrated in FIGS. 1, 2, 3 and 6. It will be appreciated that the computer work station is mobile and can be readily transported from location to location. The casters 100 are affixed to first segments 94 of bars 14, 16 and support the cabinet assembly 12. To move the work station unitarily, the work station can be pushed upon castors 100 from a position in front of the keyboard support plate 20. Feet 116, 118 are radiussed to enable them to easily slide over a floor surface. Thereafter, the work station may be directed to a new location.

Moreover, the subject invention provides a work station having superior acoustic insulative properties relative to the surrounding environ. The concave user station defined by the partition walls 110, 112, 114 serve to substantially enclose the user on three sides. Placement of the speakers 32 within the cavity 182 and pointed forward, reduces the sound escaping to the sides of the work station. The sound is directed into the concave user station defined by the partition 18 at the user. Disruption to the surrounding area is accordingly minimized.

The concave configuration of the user station defined by partition 18 further serves to visually isolate the user from the surrounding area. This reduces the level of visual distraction from outside to inside the partition 18 and vice versa. Thus, the partition 18 functions to acoustically and visually isolate the work station occupant and is particularly well suited for busy environments such as the classroom.

A further advantage of the subject invention is that all components of the computer system are secured from unwanted unauthorized exposure to the user of the work station. The CPU is isolated behind the partition and within the compartment 35 of the cabinet 12. The doors 70, 72 are secured via latch 71 into the detents 192, 194 (FIG. 7) to prevent the doors from being opened. The latch 71 preferably can be a simple rotary finger actuated by a latch knob. Alternatively, if more security is desired, a lockable latch mechanism may be incorporated openable by a key of a type common in the industry.

The CPU is contained within the cabinet and cables from peripheral devices are routed into the cabinet 12. Cables from the keyboard positioned upon keyboard support plate 20 are routed through slots 156 and 136 of the insert 22 and plate 20, respectively, and thence through the lower window portion 122 and into the compartment 35. Likewise, speaker wires are routed rearwardly from speaker cavity 182 and into the cabinet compartment 35. The speakers 32 are isolated by the lower portion 178 of bezel plate 26 and the controls of the speakers and the wires connecting the speakers to the CPU are thereby rendered inaccessible to a user of the work station absent a removal of plate 26. Tampering with the speakers and their connection wires is, accordingly, thwarted.

The monitor 28 is positioned upon the top panel 78 and the screen thereof extends through window 120 of the partition 18 to a forward side. The bezel plate 26 attaches to the forward side of the partition 18 and lower bezel plate portion 178 obscures controls to the video monitor that are typically placed below the screen. Thus, access to such controls is not permitted unless the plate 26 is removed. Once set and plate 26 attached, the vulnerability of the controls to the monitor from unauthorized tampering is eliminated. Cables from the monitor are routed down through aperture 86 in the top panel 78 and into compartment 35 for connection to the CPU.

Similarly, the bezel plate 22 secures the keyboard to the keyboard support plate 20 and protects the keyboard from removal or tampering. The cable to the keyboard routes rearwardly through the lower window opening 122 and into the compartment 35.

It will further be appreciated that the S-shaped bars 14, 16 provide a structural linkage connecting the cabinet 12, keyboard plate 20, and partition 18 together. The segments 94 of the bars 14, 16 are anchored to the cabinet bottom panel 36; mid-segments 96 of the bars reside within the bar channels 184, 186 of the partition (FIG. 7), and segments 98 of the bars extend through the partition window portion 122 and fixedly connect to the keyboard support plate 20. A structural integrity results from the interconnection of the major work station components by the bars 14, 16.

While the above describes the preferred embodiment of the subject invention, the invention is not intended to be limited thereto. Other embodiments, which will be apparent to one skilled in the art, that utilize the teachings herein set forth are intended to be within the scope and spirit of the invention.

We claim:

1. A computer work station comprising:

an enclosure assembly having an internal compartment for enclosing a computer housing therein, the compartment being defined by a top panel for supporting a computer video monitor, a bottom panel, a rearward panel and side panels extending between the top and the bottom panels;

a vertical partition located adjacent a forward side of the enclosure panel assembly and rendering the enclosure panel assembly inaccessible from a forward side of the partition;

and the partition comprising: a window positioned to align with a forward side of the computer video monitor; and a keyboard support platform located below the window and extending forward from the forward partition side and having a top surface for supporting a computer keyboard.

2. A computer work station according to claim 1, wherein the enclosure assembly side panels comprise a pivotally mounted door for accessing the internal compartment and means for locking the door to prevent unauthorized access to the compartment.

3. A computer work station according to claim 1, wherein the enclosure assembly further comprising attachment means for connecting the vertical partition to the enclosure assembly and a plurality of wheels affixed to a lower side of the bottom panel to render the enclosure assembly and the vertical partition moveable as a unit.

4. A computer work station comprising:

an enclosure assembly having an internal compartment for enclosing a computer housing therein, the compartment being defined by a top panel for supporting a computer video monitor, a bottom panel, a rearward panel and side panels extending between the top and the bottom panels;

a vertical partition located adjacent a forward side of the enclosure panel assembly and comprising: a window positioned to align with a forward side of the computer video monitor; and a forward extending keyboard support platform located below the window and having a top surface for supporting a computer keyboard;

and the keyboard support platform connects to a forward side of the enclosure assembly and projects therefrom through a second window in the vertical partition.

5. A computer work station according to claim 4, wherein the enclosure assembly further comprising at least one support bar including a first bar end segment anchored to the enclosure assembly bottom panel, a mid-segment extending upward along the forward side of the enclosure assembly; and a second bar end segment extending through the vertical partition second window and supporting the support platform thereon.

6. A computer work station according to claim 5, wherein the enclosure assembly further comprising a plurality of wheels affixed to a lower side of the support bar first end segment and supporting the enclosure assembly thereon.

7. A computer work station comprising:

an enclosure assembly having an internal compartment for enclosing a computer housing therein, the compartment being defined by a top panel for supporting a computer video monitor, a bottom panel, a rearward panel and side panels extending between the top and the bottom panels;

a vertical partition located adjacent a forward side of the enclosure panel assembly and comprising: a window positioned to align with a forward side of the computer video monitor; and a forward extending keyboard support platform located below the window and having a top surface for supporting a computer keyboard;

a first bezel plate affixed to a forward surface of the vertical partition and surrounding the first window and having peripheral plate portions positioned to overlap forwardly located controls of the video monitor and render said controls inaccessible from a forward side of the vertical partition absent removal of the first bezel plate.

8. A computer work station according to claim 7, wherein the top surface of the support platform includes a depression for receiving the keyboard therein and the support platform further comprises a second bezel plate fixedly attachable to the top surface in a position to overlap a peripheral edge of the keyboard and retain the keyboard within the depression, and the second bezel plate includes a central opening providing access to the keyboard therethrough.

9. A computer work station according to claim 7, wherein a speaker cavity is defined behind a lower portion of the first bezel plate, dimensioned to house a speaker component of the computer.

10. A computer work station according to claim 9, wherein the lower portion of the first bezel plate obscures the speaker component from the forward side of the partition and renders the speaker component inaccessible absent removal of the first bezel plate.

11. A computer work station comprising:

a shelf assembly for supporting a computer video monitor;

a vertical partition positioned adjacent and proximate to a forward side of the shelf assembly and rendering the shelf assembly inaccessible from a forward side of the partition; and the partition including a window positioned to align with a forward side of the computer video monitor;

attachment means for connecting the vertical partition and the shelf assembly together;

the partition further comprising a front panel portion and lateral side panel portions extending substantially perpendicular to the front panel portion and defining therewith an enclosure.

12. A computer work station according to claim 11, wherein the shelf assembly further comprising an enclosure assembly having an internal compartment for enclosing a computer housing therein, the compartment being defined by a top panel for supporting the computer video monitor, a bottom panel, a rearward panel and side panels extending between the top and the bottom panels; and at least one side panel comprising a pivotally mounted door for accessing the internal compartment.

13. A computer work station according to claim 12, wherein the work station further comprising wheels mounted to a lower side of the enclosure assembly and rendering the shelf assembly, the vertical partition, and the enclosure assembly moveable as a unit.

14. A computer work station according to claim 11, wherein the shelf assembly includes a plurality of wheels affixed to a lower side and rendering the shelf assembly and the vertical partition moveable as a unit.

15. A computer work station according to claim 14, wherein the work station further comprising a keyboard support platform extending forwardly from a forward side of the vertical partition positioned below the vertical partition window, the support platform having a top surface dimensioned to support a computer keyboard.

16. A computer work station comprising:

a shelf assembly for supporting a computer video monitor, a vertical partition positioned adjacent and proximate to a forward side of the shelf assembly and including a window positioned to align with a forward side of the computer video monitor;

attachment means for connecting the vertical partition and the shelf assembly together;

the partition further comprising a front panel portion and lateral side panel portions extending substantially perpendicular to the front panel portion and defining therewith an enclosure;

a first bezel plate affixable to a forward surface of the vertical partition and surrounding the window and having peripheral plate portions positioned to overlap forwardly located controls of the video monitor and render said controls inaccessible from a forward side of the partition absent removal of the first bezel plate.

17. A computer work station according to claim 16, wherein the work station further comprising a speaker cavity defined behind a lower portion of the first bezel plate.

18. A computer work station according to claim 17, wherein the lower portion of the first bezel plate obscures the speaker component from the forward side of the vertical partition and includes at least one aperture therethrough in communication with the speaker cavity.

19. A computer work station comprising:

an enclosure assembly having an internal compartment for enclosing a computer housing therein, the compartment being defined by a top panel for supporting a computer video monitor, a bottom panel, a rearward panel and side panels extending between the top and the bottom panels;

a vertical partition positioned adjacent a forward side of the enclosure panel assembly and comprising a window positioned to align with a forward side of a computer video monitor mounted upon the enclosure assembly top panel;

at least one substantially S-shaped support bar connecting the enclosure assembly and the vertical partition together, the support bar comprising a first bar end segment anchored to the enclosure assembly bottom panel; a mid-segment extending upward along a forward side of the enclosure assembly; and a second bar end segment extending through the vertical partition.

20. A computer work station according to claim 19, wherein the work station further comprises a keyboard support platform mounted to the second bar end segment.

21. A computer work station according to claim 20, wherein the work station further comprising a plurality of wheels affixed to a lower side of the first bar end segment.

22. A computer work station comprising:

a shelf assembly having a top surface for supporting a computer video monitor;

a vertical partition positioned adjacent and in close proximity to the shelf assembly and comprising a window extending therethrough substantially shaped and positioned to align with a forward side of the computer video monitor;

a bezel plate affixable to a forward surface of the vertical partition and surrounding the window, the bezel plate having peripheral plate portion s positioned to overlap forwardly located controls of the video monitor and render said controls inaccessible from a forward side of the vertical partition absent removal of the bezel plate.

23. A computer work station according to claim 22, wherein the shelf assembly comprises a top panel for supporting the computer video monitor, a bottom panel, and sidewalls extending between the top and bottom panels to define therewith an internal compartment dimensioned to receive a computer housing.

24. A computer work station according to claim 23, wherein the shelf assembly internal compartment is enclosed and the sidewalls comprise a pivotally mounted door for providing access to the internal compartment.

25. A computer work station accord ing to claim 22, the work station further comprising a speaker component cavity behind a lower portion of the bezel plate, positioned below the window; and the bezel plate lower portion is positioned to obscure the computer speaker cavity and render the computer speakers inaccessible from a forward side of the vertical partition.

* * * * *